United States Patent [19]

Kang

[11] Patent Number: 5,035,666

[45] Date of Patent: Jul. 30, 1991

[54] BLOCKS WITH PLATFORM, WHEEL AND RECESSES

[75] Inventor: Yung J. Kang, Seoul, Rep. of Korea

[73] Assignee: Dae Kyo Limited, Seoul, Rep. of Korea

[21] Appl. No.: 440,147

[22] Filed: Nov. 22, 1989

[51] Int. Cl.[5] ..... A63H 33/06; A63H 33/00; A63H 33/08

[52] U.S. Cl. ..... 446/118; 446/69; 446/124

[58] Field of Search ..... 446/118, 69, 117, 119, 446/120, 121, 84, 124

[56] References Cited

U.S. PATENT DOCUMENTS

| | | | |
|---|---|---|---|
| 1,736,134 | 11/1929 | Rutherford | 446/118 |
| 1,895,611 | 1/1933 | Doak | 446/117 X |
| 2,883,764 | 4/1959 | Stephens | 446/118 |
| 2,961,779 | 11/1960 | Perry | 446/121 X |
| 3,577,671 | 5/1971 | Woollett | 446/124 |
| 3,844,568 | 10/1974 | Armstrong | 446/118 X |
| 4,026,065 | 5/1977 | Dick | 446/121 |
| 4,249,336 | 2/1981 | Moe et al. | 446/118 X |
| 4,778,392 | 10/1988 | Mitchell | 446/117 X |
| 4,809,980 | 3/1989 | Bertrand | 446/118 X |
| 4,861,307 | 8/1989 | Larws | 446/124 X |

FOREIGN PATENT DOCUMENTS

| | | | |
|---|---|---|---|
| 3602630 | 7/1987 | Fed. Rep. of Germany | 446/124 |
| 660422 | 7/1929 | France | 446/117 |
| 14957 | of 1895 | United Kingdom | 446/87 |
| 214821 | 5/1924 | United Kingdom | 446/119 |

*Primary Examiner*—Robert A. Hafer
*Assistant Examiner*—D. Neal Muir
*Attorney, Agent, or Firm*—Pollock, Vande Sande & Priddy

[57] ABSTRACT

An educational and recreational toy for babies and children including: a plurality of rectangular blocks 30 having rectangular protrusions 31 provided with letters, figures and symbols selectively placed thereon and rectangular recesses 32 for connection to protrusions on other blocks; a plurality of triangular blocks 40 having rectangular and triangular protrusions 41, 42 and recess 44 thereon respectively; a platform 20 having a plurality of protrusions 10 on its front surface; and wheel means 60 having a rectangular recess 61 at the center. According to the invention, various letters, figures, and patterns as well as a dynamic playing model such as an airplane and an automobile can be made, so that babies and children can play, while at the same time, various educational effects can be obtained naturally.

4 Claims, 7 Drawing Sheets

BLOCKS WITH PLATFORM, WHEEL AND RECESSES

BACKGROUND OF THE INVENTION

The present invention relates to educational and recreational toys for babies and children.

Heretofore, various educational toys have been proposed, but they mainly worked by moving pieces of letters or patterns within a plane of a frame, and therefore play with these was monotonous, the children becoming dissatisfied within a short time. Toys having more variety than these have been proposed; however, these were merely articles for matching colors, and, this being the only function of the toy, the educational values were low.

There have also been proposed such articles which are formed as charts for children to learn letters or figures and the like; however, such articles were not effective in responding to variations in learning abilities.

Although various kind of toys and learning implements for use in various modes have been developed, there still remains a need for learning materials which can be utilized as a toy capable of providing enjoyment for babies and children, and at the same time, providing various educational purposes such as memorizing, thinking ability and creative ability.

SUMMARY OF THE INVENTION

An object of the present invention is to provide a learning assembly system which is compatible with a function as a toy and functions for solving various problems. Another object of the present invention is to provide a toy for study combined with play which makes it pleasant to learn systematic arithmetic lessons in response to instructions by utilizing cubic blocks, triangular blocks, a platform and wheel means.

Still another object of the present invention is to provide a toy for playing and studying simultaneously by making letters, figures and patterns using only cubic and triangular blocks.

Yet another object of the present invention is to provide a toy capable of selectively utilizing a platform as a learning implement, such as a blackboard.

The foregoing and other objects as well as advantages of the present invention will become clear by the following description of the invention with reference to the accompanying drawings.

In accordance with the present invention there is provided an educational and recreational modular assembly system comprising a plurality of six-sided cubic blocks and a plurality of five-sided prism-shaped blocks having a pair of opposed triangular sides, each of said blocks having sides with protrusions and sides with recesses for coupling with protrusions on other blocks. The assembly includes a platform having protrusions for coupling with recesses in the blocks and a wheel element having an axial opening adapted to receive a cubic block.

BRIEF DESCRIPTION OF THE DRAWINGS

For a better understanding of the invention, and to show how the invention may be carried out, reference will now be made, by way of example, to the accompanying drawings.

Throughout the drawings, like reference numerals and symbols are used for designating like or equivalent parts or portions.

DETAILED DESCRIPTION OF THE INVENTION

Hereinafter, the structure and operation of the present invention will be described in detail with reference to the accompanying drawings.

Figure 1:
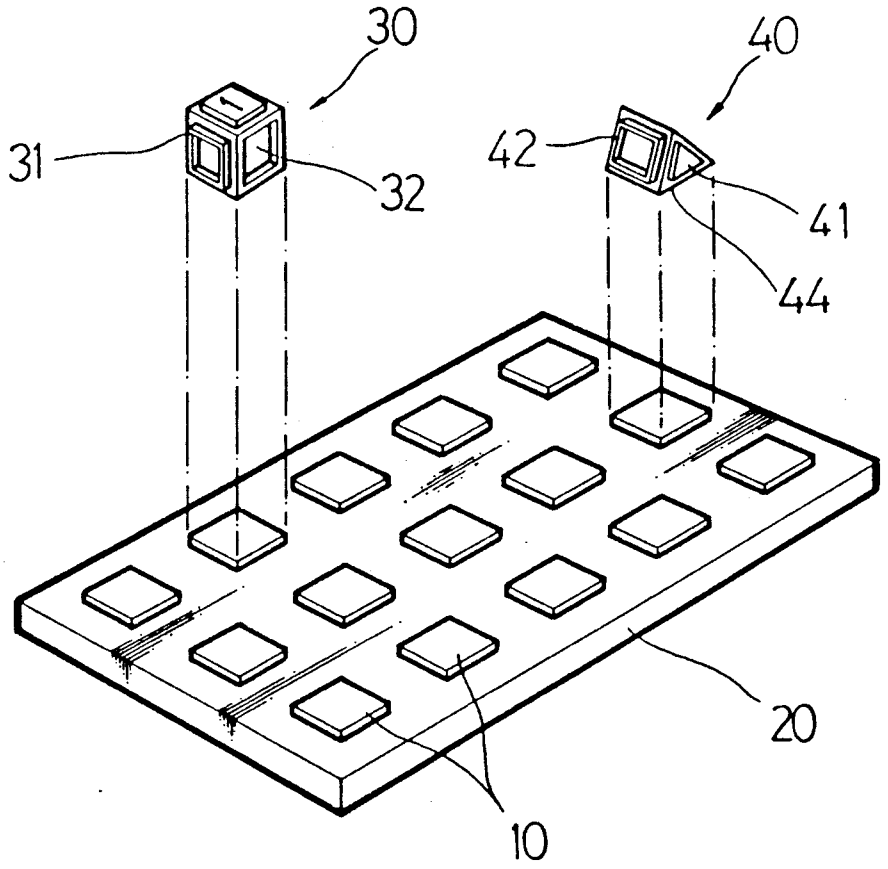
FIG. 1 is a perspective view of a portion of the present invention.
Figure 2A:
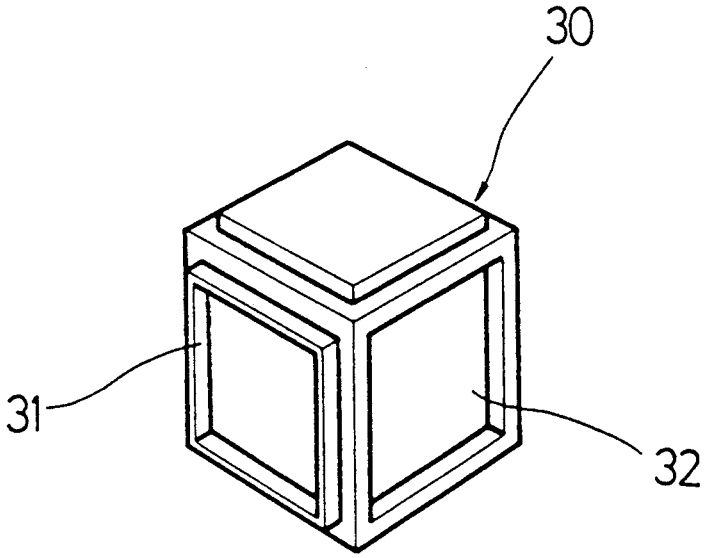
FIGS. 2(A) and 2(B) are perspective views of cubic and triangular blocks respectively according to the present invention.
Figure 2B:
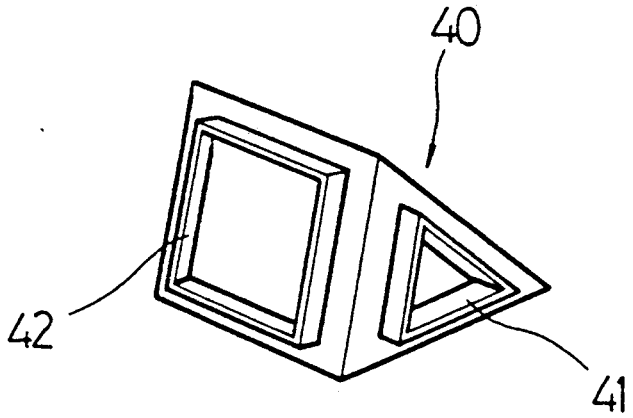
Figure 3A:
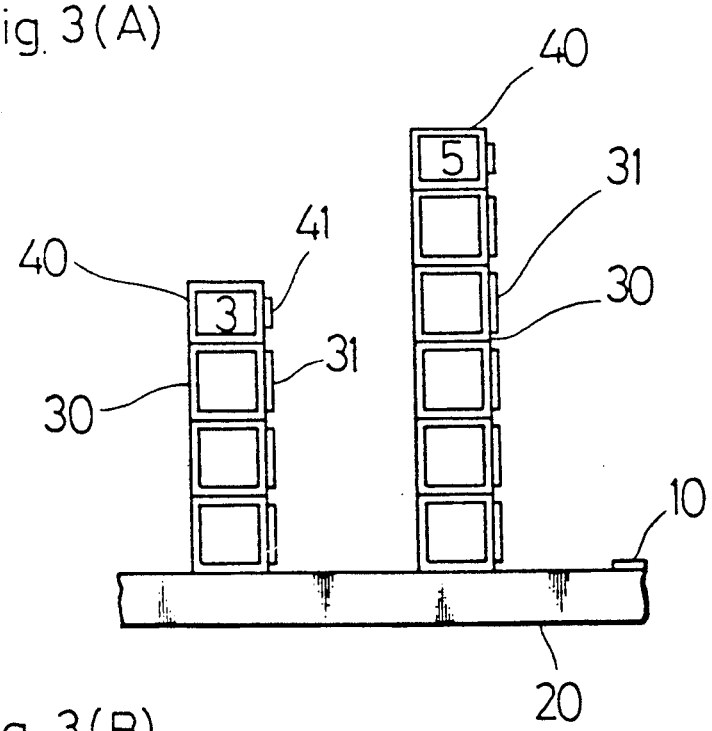
FIG. 3(A) is a front elevational view for showing use of the blocks to form a tower.
Figure 3B:
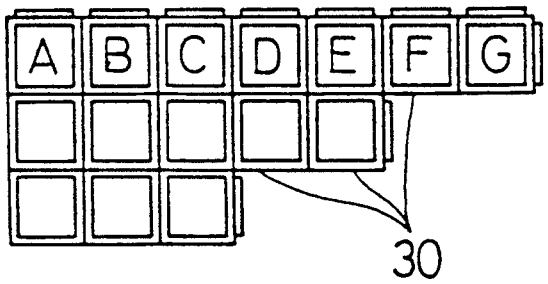
FIG. 3(B) is a top view showing an arrangement of the blocks in alphabetical order.
Figure 3C:
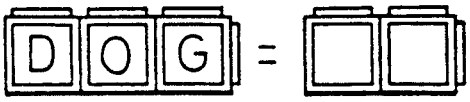
FIG. 3(C) is a diagram showing an arrangement of the blocks for learning a foreign language.
Figure 3:
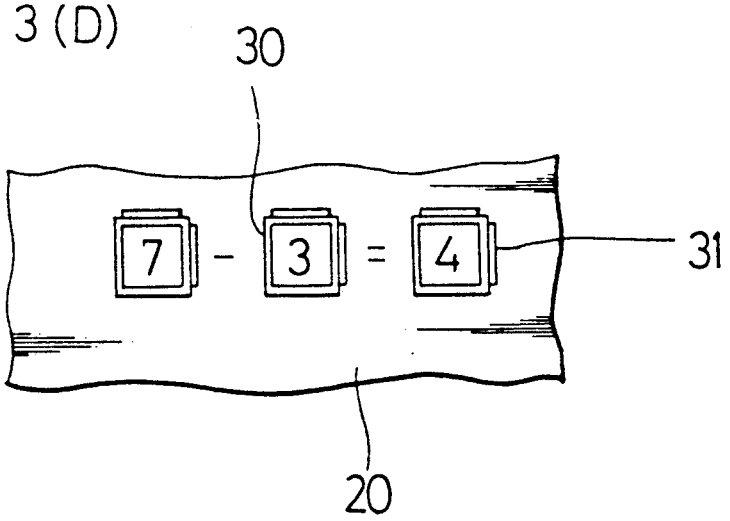
FIG. 3(D) is a diagram showing an arrangement of the blocks and board for an arithmetic lesson.
FIG. 3(E) is a diagram showing use of the blocks and board in a puzzle.
Figure 3:
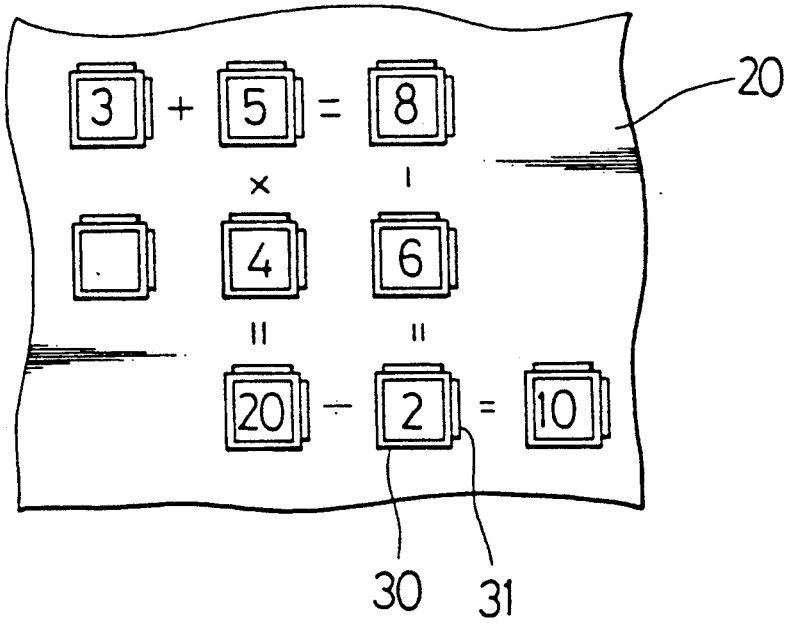
Figure 5:
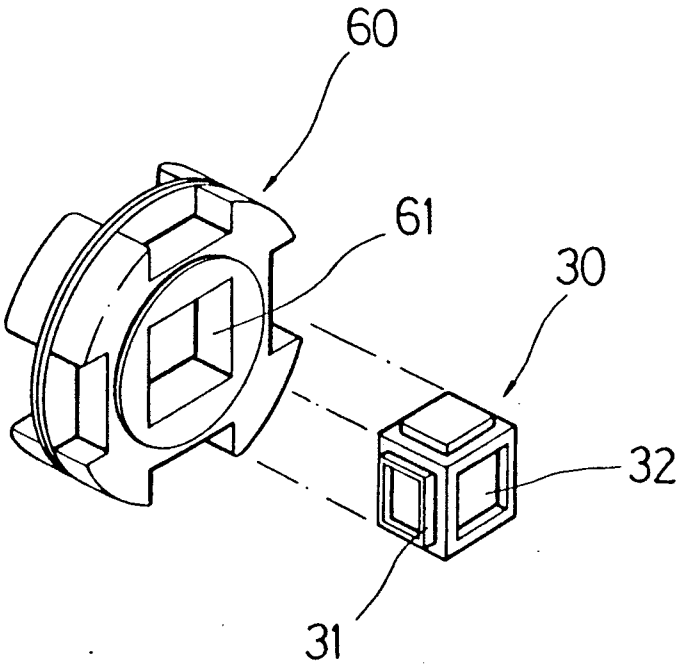

Referring to FIG. 1, the present invention includes a plurality of cubic blocks 30 and triangular blocks 40 and platform 20 utilized for multilateral learning material. FIG. 5 shows wheel means 60 utilized mainly for play.

Cubic block 30 is formed with protrusions 31 and recesses 32 on the six sides of the body. Letters, figures, and symbols are placed on the surfaces of the protrusions. Other protrusions 42 are formed on two rectangular sides of triangular prism-shaped block 40 having five sides. Triangularly shaped protrusion 41 and recess 44 are formed on the two opposed sides at the ends of the triangular block.

The cubic blocks 30 and triangular blocks 40 are manufactured in a plurality of colors so that the effect of a lesson can be increased by requiring that a child discriminate between various colors. Protrusions 31, 41, or 42 of one block and recesses 32, 33, or 44 of another block are capable of being coupled and released so that various functions such as inserting, matching, piling and patterning etc. are possible.

Letters and figures and the like formed with curves can be made by utilizing triangular blocks 40. In addition, a plurality of protrusions 10 are formed on the front surface of platform 20, the rear surface of which is planar. Various lessons can be carried out by coupling cubic blocks 30 and triangular blocks 40 to protrusions 10. Furthermore, after writing letters or drawing pictures with colored pencils or pens etc. on the rear surface, the writing can be erased, the rear surface serving as a blackboard.

Referring to FIG. 5, rectangular recess 61 is formed at the center of wheel means 60 and cubic block 30 or triangular block 40 is coupled to recess 61 whereby a dynamic model, particularly a model having wheels, such as an airplane or an automobile and the like can be made, thus developing the creative abilities of babies and children.

Figure 4A:
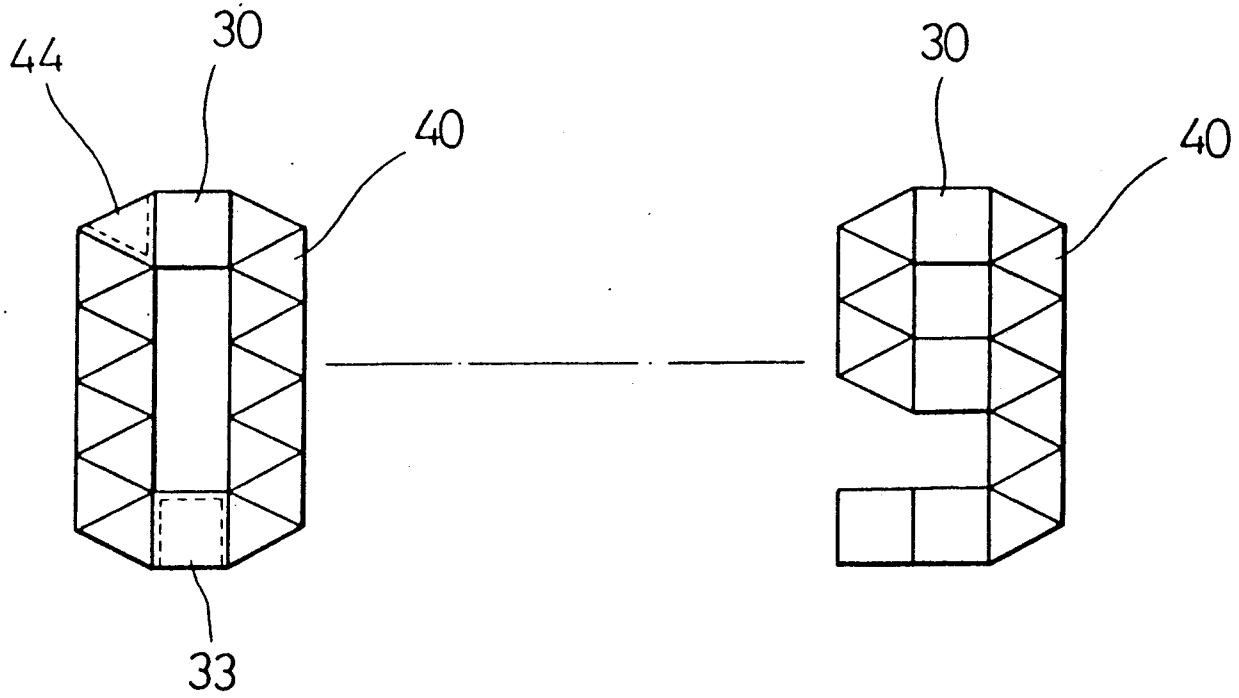
FIGS. 4(A) and 4(B) are exemplary diagrams of arrangements of triangular blocks having curved paths; and, FIG. 5 is a perspective view showing an arrangement for coupling a cubic block to wheel means.
Figure 4B:
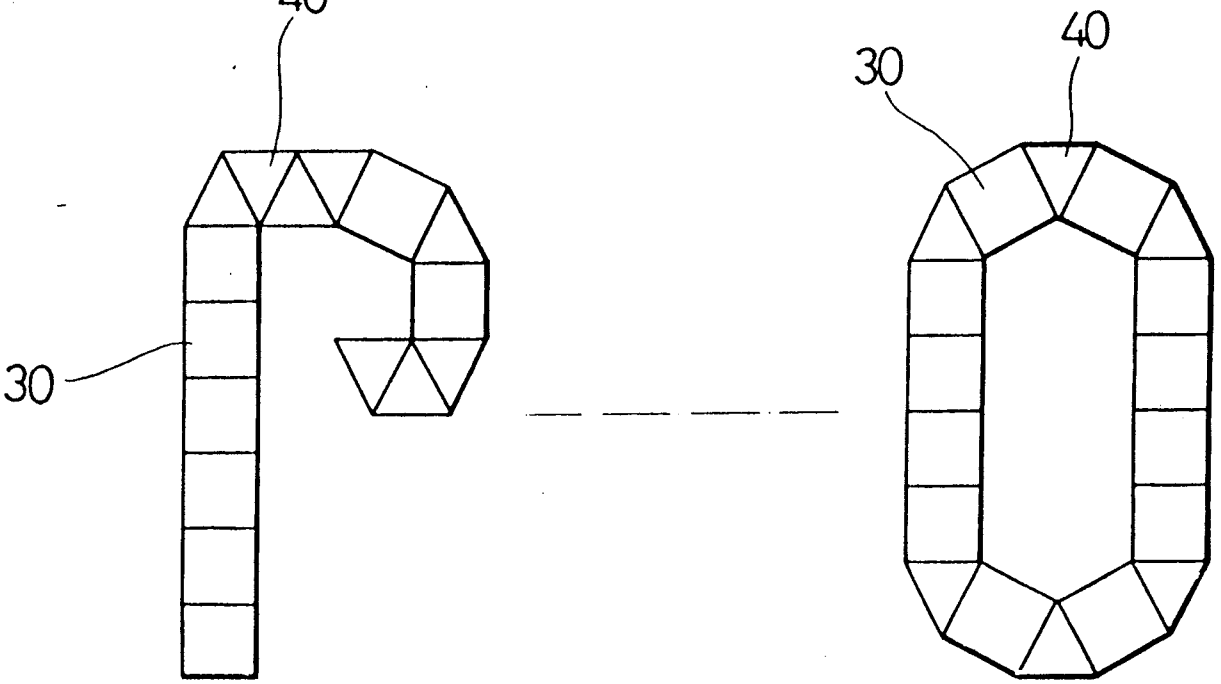

Explaining in more detail the application of the present invention, constructed as aforementioned as shown in FIGS. 3(A) and 3(B), 3(C), 3(D) and 3(E), not only can various lessons such as an arithmetic lesson, memorization of words, learning a foreign language, and solving puzzles etc. be carried out by utilizing the blocks 30 and 40, but also, as shown in FIGS. 4(A) and 4(B), letters and figures can be made by coupling the cubic and triangular blocks. Further, as shown in FIG. 5, various types of models can be made by coupling the cubic and triangular blocks to recess 61 of wheel mean 60.

The beneficial effects of the present invention may be explained as follows:

First, the present invention is an educational means for step-by-step systematic learning. While babies typically play only with uncoupled blocks, eventually they are able to couple and release the blocks on the platform, so that ability to concentrate and observe can be cultivated naturally merely through play.

Second, since connections among blocks can be made freely, the formation of a desired model in response to instructions can be carried out systematically through play.

Third, a learning effect may be controlled in response to the ability and growth of each child, so that a basic education can be carried out pleasantly through puzzles.

Fourth, it is possible for the scope of teaching to extend from basic lessons such as discrimination of color tones and discrimination of patterns etc. to even multiplication in response to the systematic teaching of an instruction manual so that pleasant arithmetic lessons are possible.

Thus, since the present invention can be utilized to implement studies to an even greater extent than the effect described above, it is very useful for the development of intelligence in children.

What is claimed is:

1. An educational and recreational modular assembly system comprising:

(a) a plurality of six-sided cubic blocks, each of said blocks having rectangular recesses on at least two of said sides and rectangular protrusions on at least two other of said sides, said protrusions being adapted to couple with rectangular recesses in other blocks for joining blocks together;

(b) a plurality of five-sided, prism-shaped blocks having a pair of opposed triangular sides and three rectangular sides, one of said triangular sides having a triangular recess and the opposing triangular side having a triangular protrusion adapted to couple with a triangular recess on another of said five-sided blocks, two of the rectangular sides of said five-sided blocks having rectangular protrusions and the remaining side having a rectangular recess adapted to couple with a rectangular protrusion on said cubic blocks or a rectangular protrusion on another of said prism-shaped blocks; and, (c) a platform having an upper surface provided with a plurality of rectangular protrusions, each of which is adapted to couple with a rectangular recess in said cubic blocks or a rectangular recess in said prism-shaped blocks.

2. An educational and recreational modular assembly according to claim 1 wherein said platform has a planar lower surface adapted for use as a blackboard.

3. An educational and recreational modular assembly according to claim 1 wherein at last one protrusion on said cubic block is provided with a symbol.

4. An educational and recreational modular assembly according to claim 1 further including a wheel-like block having a rectangular axial opening adapted for insertion and retention therein of one of said cubic blocks.

* * * * *